United States Patent [19]

Millard et al.

[11] 4,278,513

[45] Jul. 14, 1981

[54] TWO-STAGE DIFFERENTIAL ANODIZATION PROCESS

[75] Inventors: Richard J. Millard; Walter J. Bernard; Alfred Whitman, all of Williamstown, Mass.

[73] Assignee: Sprague Electric Company, North Adams, Mass.

[21] Appl. No.: 164,650

[22] Filed: Jun. 30, 1980

[51] Int. Cl.[3] ..... C25D 11/12

[52] U.S. Cl. ..... 204/42; 204/56 R

[58] Field of Search ..... 204/42, 56 R, 58

[56] References Cited

U.S. PATENT DOCUMENTS

| | | | |
|---|---|---|---|
| 3,415,722 | 12/1968 | Scheller et al. | 204/15 |
| 4,131,520 | 12/1978 | Bernard et al. | 204/42 |

FOREIGN PATENT DOCUMENTS 835091 5/1960 United Kingdom .

*Primary Examiner*—G. L. Kaplan

*Attorney, Agent, or Firm*—Connolly and Hutz

[57] ABSTRACT

In a two-stage differential anodization of valve-metal pellets in which the second stage is carried out at a high voltage and with a different electrolyte than the first, underformed spots on the pellets are eliminated in the second stage by adding 0.01–1.0 wt. % of a nonionic surfactant to the second stage electrolyte.

3 Claims, No Drawings

TWO-STAGE DIFFERENTIAL ANODIZATION PROCESS

BACKGROUND OF THE INVENTION

This invention relates to a two-stage differential anodization of valve-metal pellets, and specifically to the use of a nonionic surfactant in the second, higher voltage, stage to eliminate underformed spots.

The two-stage differential anodization process has been described by Bernard and Szpak in U.S. Pat. No. 4,131,520, issued Dec. 26, 1978. In their process, valve-metal pellets are first anodized in a conventional electrolyte during which a uniform film of anodic oxide is formed throughout the pellet structure. In the second stage, a different electrolyte is used to form an outer layer or shell, and the anodization (or formation) is carried out at a higher voltage.

When producing pellet anodes on a large scale using the above method, it was noticed that there were underformed spots in the outer or shell layer. When the valve-metal is tantalum, such spots are easy to detect visually, because of the difference in colors of the anodic oxide formed at different voltages.

SUMMARY OF THE INVENTION

It is the object of this invention to eliminate underformed spots on the outer or shell layer formed in the two-stage differential anodization of valve-metal pellets.

This aim is accomplished by adding 0.01–1.0 wt % of a nonionic surfactant to the second-stage electrolyte.

It was observed that bubbles were clinging to the bottom surface of the pellets during the second-stage anodization. These bubbles are oxygen formed by the large charge passed during anodization and trapped by the bottom horizontal surface of the pellets. If these trapped bubbles become large enough, they can block current flow to the pellet beneath and result in a thinner, underformed, layer at the bubble-pellet contact area.

The use of vibration to dislodge the bubbles or to prevent the formation of bubbles large enough to block the current flow was only partly successful. Similarly, increasing the amount of solute in the second-stage electrolyte gave mixed results.

These and other results indicated the presence of a thin layer of hydrophobic material on the surface of the pellets. Such material would commonly be present in a manufacturing plant atmosphere. Since the pellets after rinsing following the first-stage anodization were exposed to this atmosphere, such material could be deposited or adsorbed on the surface of the pellets.

A degreasing step was tried but did not prove satisfactory. Another approach was to heat the pellets to vaporize such material immediately before the second-stage anodization. This approach was successful but had the drawback of damaging the first-stage layer.

Runs were made whereby the pellets were kept wet and out of contact with the air between the first and second stages. This approach was also satisfactory but would necessitate equipment changes and increase manufacturing costs.

Finally, surfactants were tried. The first was an anionic surfactant, and it interferred with the anodic formation of the outer shell. Because it was anionic, it nullified the diffusion into the pores of the second stage electrolyte and the blocking action of the solvent and conducted current into the interior of the pellet. As a result, formation took place throughout the pellet instead of only on the pellet surface. To be effective, the surfactant must not conduct nor give rise to a conducting species under the influence of the large current charge being passed during anodization.

A nonionic surfactant was tried next. At a 0.01 wt % concentration, spots were very small and faint; increasing the concentration to 0.05 wt % gave almost imperceptible spots. More than 1.0 wt % was found to be unnecessary and began to create rinsing problems.

DESCRIPTION OF THE PREFERRED EMBODIMENTS

A series of tantalum pellets of different sizes were processed with and without a nonionic wetting agent. The wetting agent employed is a coadduct of ethylene glycol and 2,4,7,9-tetramethyl-5-decyne-4,7-diol, commercially available as Surfynol 465 from Air Products & Chemical Co. Laboratory runs using 0.05, 0.1, 0.2, and 1 wt % Surfynol 465 solutions had established that the 0.05 to 0.2 wt % level was satisfactory for reducing the underformed spots. In the three lots below, 0.1 wt % was used. The fraction S/P represents the number of spotted pellets (S) compared to the total number of pellets (P) in the lot. Shell voltage was varied from 60 to 95 volts. The surfactant was unaffected by the large amounts of current passed during anodization.

TABLE 1

| | No surfactant | | Surfactant | |
|---|---|---|---|---|
| | S/P | % spots | S/P | % spots |
| Lot #1 | 284/570 | 49.8 | 10/760 | 1.3 |
| Lot #2 | 188/380 | 49.1 | 2/190 | 1.0 |
| Lot #3 | 54/240 | 22.5 | 0/80 | 0.0 |

No simple explanation can be given for the success of the surfactant. Size of bubbles play a role, as the vibration tests showed, but was not the complete answer as pellets still were spotted. Heating did remove the film but hurt the first stage oxide, while keeping the pellets wet appeared to prevent spot formation. The answer appears to be a combination of removing or perhaps wetting through the film (as degreasing did not work) and decreasing the bubble sizes.

What is claimed:

1. In a process for the differential anodization of valve-metal pellets in two-stages, in which the second stage is carried out in a different electrolyte and at a higher voltage than the first stage and in which said second stage electrolyte comprises a salt of a water-soluble weak acid having a dissociation constant of less than $1.0\times10^{-4}$, the improvement comprising the addition of 0.01–1.0 wt % of a nonionic surfactant to said second stage electrolyte to reduce underformed spots in the higher voltage layer being formed and then rinsing the pellets free of said second-stage electrolyte.

2. A process according to claim 1 wherein said nonionic surfactant is a 0.05 to 0.2 wt % solution of a coadduct of ethylene glycol and 2,4,7,9-tetramethyl-5-decyne-4,7-diol.

3. A process according to claim 1 wherein said valve-metal pellet is a tantalum pellet.

* * * * *